United States Patent [19]

Biller

[11] Patent Number: 4,687,277

[45] Date of Patent: Aug. 18, 1987

[54] ARRANGEMENT FOR CONNECTING AN ELECTRIC DEVICE WITH A MOUNTING THEREFOR

[75] Inventor: Bruce A. Biller, Chicago, Ill.

[73] Assignee: S&C Electric Company, Chicago, Ill.

[21] Appl. No.: 910,274

[22] Filed: Sep. 16, 1986

Related U.S. Application Data

[63] Continuation of Ser. No. 726,863, Apr. 25, 1985, abandoned.

[51] Int. Cl.[4] ..... H01R 13/645

[52] U.S. Cl. ..... 439/621; 439/679; 439/804

[58] Field of Search ..... 339/184 R, 184 M, 186 R, 339/186 M, 265 R, 265 F, 147 R, 147 C, 147 P, 32 R, 32 M

[56] References Cited

U.S. PATENT DOCUMENTS

| | | | |
|---|---|---|---|
| 1,808,769 | 6/1931 | Dibner | 339/265 F |
| 2,573,710 | 11/1951 | Holke | 339/265 F |
| 2,582,384 | 1/1952 | Knollman | 339/265 F |
| 2,958,014 | 10/1960 | Blain | 339/184 M |
| 3,100,672 | 8/1963 | Myers | 339/265 |
| 3,229,242 | 1/1966 | Finney et al. | 339/184 R |
| 4,268,811 | 5/1981 | Evans et al. | 337/156 |
| 4,422,062 | 12/1983 | Biller et al. | 337/174 |

FOREIGN PATENT DOCUMENTS

| | | | |
|---|---|---|---|
| 832658 | 4/1960 | United Kingdom | 339/184 R |

*Primary Examiner*—John McQuade

*Attorney, Agent, or Firm*—James V. Lapacek

[57] ABSTRACT

An arrangement is provided for selectively associating and connecting an electrical device such as a fuse with a mounting therefor. The arrangement includes an efficient connection device that is clamped at each end of the electrical device to end studs protruding from the ends of the electrical device. In a specific embodiment, the efficient connection device includes a contact bar fabricated from wrought copper that is directly clamped to the end studs and that directly connects to the contacts of the mounting. The connection device also includes provisions to prevent the assembly of distinct electrical devices with different predetermined ratings or characteristics into connection devices other than the connection device corresponding to the appropriate electrical device. The arrangement also includes structure for associating the connection device and carried electrical device with a mounting and for preventing the cooperation and connection of the carried electrical device with mountings other than those that correspond to the appropriate electrical device as to the predetermined ratings or characteristics. In one specific embodiment, the arrangement includes predetermined cooperative interfitting tabs and notches on the carried electrical device and the mounting to ensure that only the appropriate electrical device is capable of being connected to a particular, corresponding mounting. The clamping structure for the connection device includes predetermined geometric characteristics to prevent the inappropriate electrical devices from being assembled to the arrangement.

13 Claims, 9 Drawing Figures

30
53
32
39
44
41
43
42
26
37
47
38
20
16
10
12
14
10
24
18
49
51
28
22
40
48
36
114
45,46
113
57
50
59
34

FIG 4
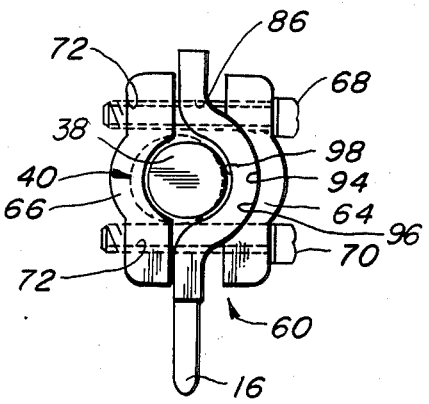
FIG 5
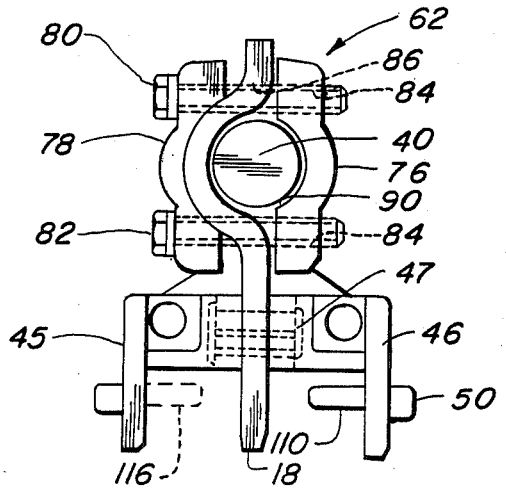
FIG 6
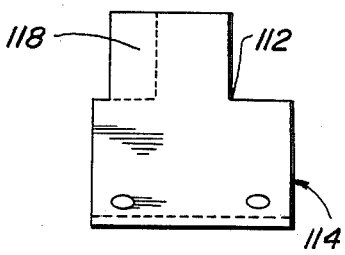
FIG 7
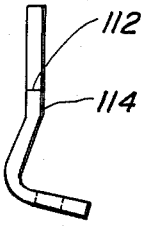
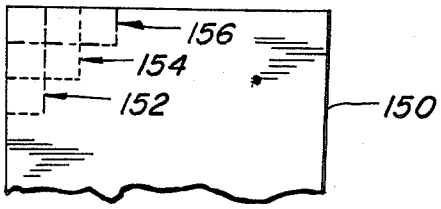
FIG 8
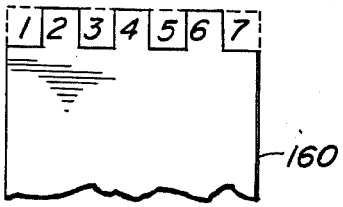
FIG 9

ARRANGEMENT FOR CONNECTING AN ELECTRIC DEVICE WITH A MOUNTING THEREFOR

This is a continuation, of application Ser. No. 726,863, filed Apr. 25, 1985, and now abandoned.

BACKGROUND OF THE INVENTION

1. Field of the Invention

The present invention relates generally to an arrangement for associating and connecting an electrical device with a mounting therefor and more particularly to apparatus for ensuring that only the appropriate electrical device of predetermined ratings and/or characteristics can be connected to the corresponding mounting.

2. Discussion of the Related Art

Various arrangements are known for associating and connecting electrical devices with mountings and appropriate circuit contacts. For example, two such arrangements are disclosed in U.S. Pat. Nos. 4,422,062 and 4,268,811.

While these arrangements are suitable for their intended purpose, it is always desirable to provide improved connecting and associating arrangement to assist in avoiding inappropriate assembly and insertion of different devices into other than the corresponding, appropriate mountings.

For example, where an electrical device includes replaceable modules and interfitting modules, it would be desirable to provide an arrangement to efficiently ensure that the replaced modules will be appropriately assembled to the associating and connecting structure.

SUMMARY OF THE INVENTION

Accordingly, it is a principal object of the present invention to provide an efficient arrangement for associating and connecting an electrical device with the appropriate, corresponding mounting while preventing the cooperation and connection of the electrical device with mountings other than the appropriate mountings.

It is another object of the present invention to provide an efficient contact for providing a highly conductive path from the contact of an electrical device to the contact of a mounting.

It is a further object of the present invention to provide an improved associating and connecting arrangement for electrical devices and mountings wherein the efficient connection arrangement also provides the function of preventing the inappropriate assembly, association or connection of electrical devices with respect to mountings that are inappropriate for the particular electrical device.

Briefly, these and other objects and advantages of the present invention are efficiently achieved by providing an arrangement for selectively associating and connecting an electrical device such as a fuse with a mounting therefor. The arrangement includes an efficient connection device that is clamped at each end of the electrical device to end studs protruding from the ends of the electrical device. In a specific embodiment, the efficient connection device includes a contact bar fabricated from wrought copper that is directly clamped to the end studs and that directly connects to the contacts of the mounting. The connection device also includes provisions to prevent the assembly of distinct electrical devices with different predetermined ratings or characteristics into connection devices other than the connection device corresponding to the appropriate electrical device. The arrangement also includes structure for associating the connection device and carried electrical device with a mounting and for preventing the cooperation and connection of the carried electrical device with mountings other than those that correspond to the appropriate electrical device as to the predetermined ratings or characteristics. In one specific embodiment, the arrangement includes predetermined cooperative interfitting tabs and notches on the carried electrical device and the mounting to ensure that only the appropriate electrical device is capable of being connected to a particular, corresponding mounting. The clamping structure for the connection device includes predetermined geometric characteristics to prevent the inappropriate electrical devices from being assembled to the arrangement.

BRIEF DESCRIPTION OF THE DRAWINGS

The invention, both as to its organization and method of operation, together with further objects and advantages thereof, will best be understood by reference to the following specification taken in conjunction with the accompanying drawing in which like reference numerals refer to like elements and in which:

FIGS. 4 and 5 are respective plan views of the upper and lower connecting and associating arrangements attached to the electrical device of FIGS. 1–3;

FIGS. 6 and 7 are respective front and side elevational views of a blocking member of FIG. 1 utilized in the practice of the present invention; and FIGS. 8 and 9 are diagrammatic representations of alternate, specific embodiments of blocking members to practice the present invention.

DETAILED DESCRIPTION

Figure 1:
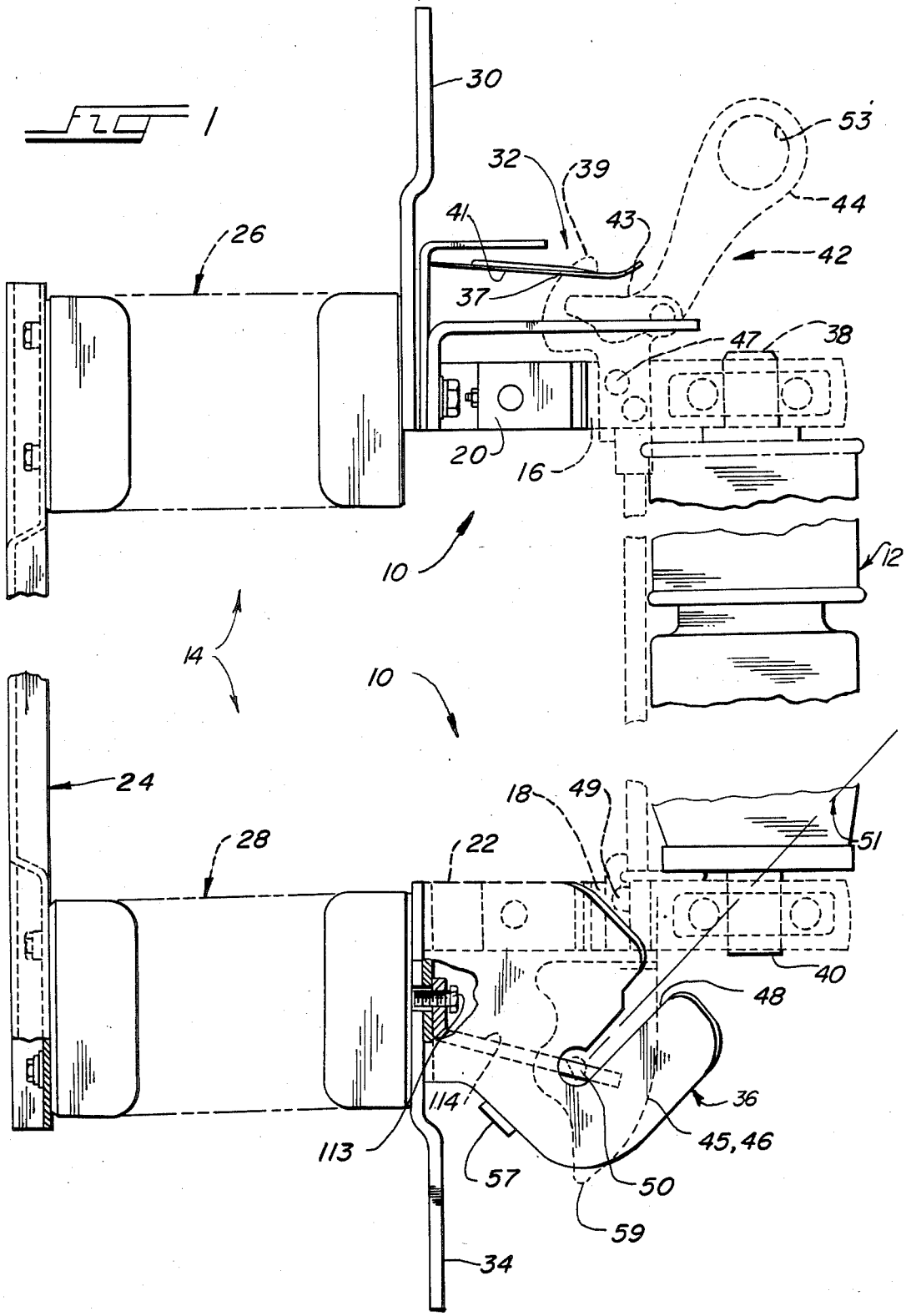
FIG. 1 is an elevational view of the arrangement of the present invention for the emplacement and removal of the illustrated electrical device with respect to the illustrated mounting.
Figure 2:
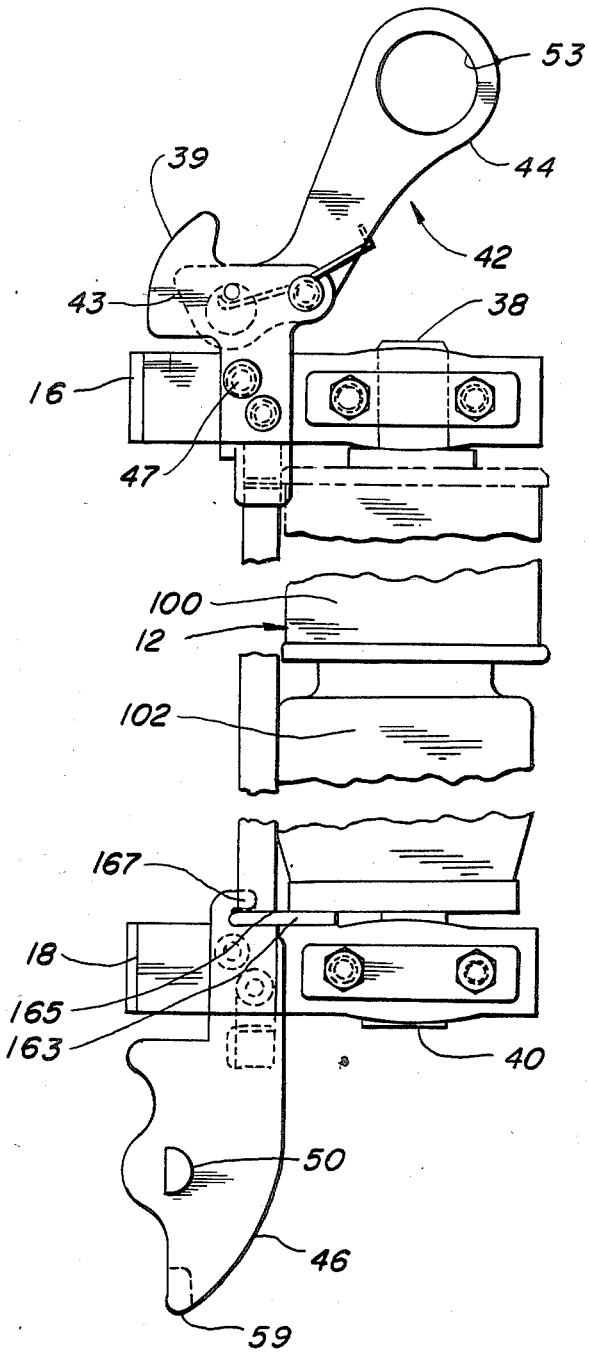
FIGS. 2 and 3 are respective side and front elevational views of the electrical device and associating and connecting arrangements of FIG. 1 as provided with the arrangement of the present invention.
Figure 3:
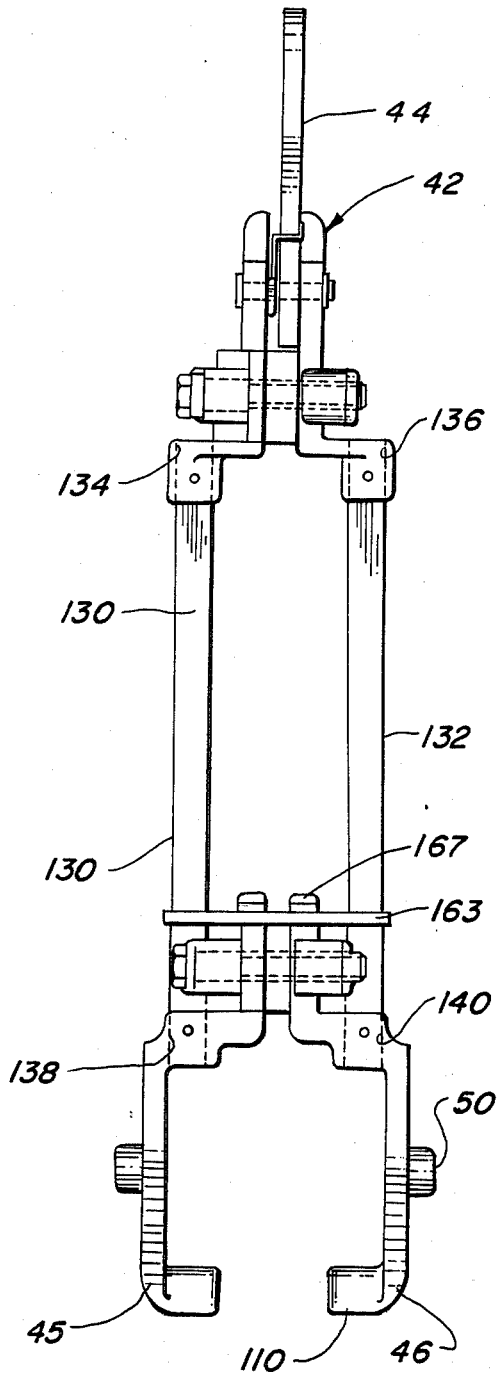

Referring now to FIG. 1, a specific embodiment of the arrangement 10 of the present invention is illustrated for the emplacement and removal of an electrical device 12 with respect to a mounting 14; the contacts 16,18 of the arrangement 10 selectively interconnecting with the respective stationary contacts 20,22 of the mounting 14. The mounting 14 includes a base 24 and upper and lower support insulators 26,28 respectively; the support insulators 26,28 being affixed to and extending from the base 24. The outer end of the upper support insulator 26 carries the upper stationary contact 20 and an upper connector bus 30 electrically connected to the contact 20. A latch receiver assembly 32 is also carried by the upper support insulator 26. The lower support insulator 28 at the outer end thereof carries the lower stationary contact 22 and a lower connector bus 34 electrically connected to the contact 22. A hinge assembly 36 is also carried by the lower support insulator 28.

The electrical device 12 is shown in FIG. 1 in the inserted, interconnected position with respect to the mounting 14; the electrical device 12 including at the upper and lower ends thereof, conductive studs 38,40 which are affixed to the contacts 16,18 respectively as will be explained in more detail hereinafter. A latch member and retainer assembly 42 is affixed to the contact 16 by means of suitable fasteners such as rivets 47. The latch member and retainer assembly 42 cooperates with the latch receiver assembly 32 to selectively latch the assembly 42 and carried electrical device 12 in the position of FIG. 1 or to selectively release the latch member and retainer assembly 42 from the mounting 14 upon rotation of a rotatably mounted lever 44. Rotation of the lever 44 via portion 43 moves the capture plate 41 to release the latch member at 39 from an aperture 37 in the capture plate 41 and thus release the assembly 42 and the top end of the carried electrical device 12. Two trunnion members 45,46 are affixed to the lower contact 18 for cooperation with the hinge assembly 36. The trunnions are affixed by suitable fasteners such as the rivets 49. The hinge assembly 36 includes slots 48 which receive trunnion bosses 50 for support of the trunnion members 45,46 and carried electrical device 12 by the hinge assembly 36. The line 51 illustrates the path of insertion of the bosses 50 of the trunnion members 45,46 into the hinge assembly 36. After insertion of the bosses 50 to the point as shown in FIG. 1, the electrical device 12, with the attached trunnion member 45,46 and latch member and retainer assembly 42, is rotated to the position of FIG. 1 with the latch member portion 39 pivoting the capture plate 41 until the portion 39 moves through the aperture 37. An aperture 53 is provided in the lever 44 to provide facility for emplacement and removal of the assembly 42, trunnion members 45,46 and the device 12 with respect to the mounting 14 by a suitable handling tool. Specifically, the assembly 42, the electrical device 12 and trunnion members 45,46 are pivoted to the position along the line 51 and withdrawn away from the mounting 14 by the lifting of the device 12 so as to move the bosses 50 along the slots 48. A limit bar 57 spans the generally-open hinge assembly 36. A tip portion 59 of each trunnion member 45,46 contacts the limit bar 57 to define a maximum pivoted position along the line 51.

With reference now additionally to FIGS. 2–5, the arrangement 10 of the present invention includes clamps 60,62 for affixing the contacts 16,18 to the studs 38,40 of the electrical device 12. Specifically, the clamp 60 includes two clamp members 64,66 for clamping the upper contact 16 to the device stud 38; the clamp members 64,66 being clamped by the provision of bolts 68,70 through threaded apertures 72 of the clamp member 66. Similarly, the clamp 62 includes clamp members 76,78 for clamping the lower device stud 40 to the lower contact 18 by means of bolts 80,82 and threaded apertures 84. The contacts 16,18 are suitably shaped and include the provision of suitable apertures 86 for the passage of the respective bolts 68,70,80 and 82.

In accordance with the features of one specific embodiment of the arrangement 10 of the present invention, the diameter D1 of the upper device stud 38 is a predetermined amount smaller than the diameter D2 of the lower device stud 40. Further, the clamp members 66 and 76 and the contacts 16,18 are fabricated with suitable inner radii such as at 90 to conform to the respective device stud; e.g. the radius 90 of the clamp member 76 corresponding to the larger device stud 40. Accordingly, if it is attempted to assemble the clamp members 64,66 about the lower device stud 40 as indicated in phantom in FIG. 4, the device stud 40 interferes with the bolts 68,70 such that the bolts cannot be aligned to be threaded into the clamp member 66. This feature is desirable where the electrical device does not exhibit the same characteristics bidirectionally; i.e. the electrical device exhibits different characteristics from device stud 38 to 40 as opposed to the direction from device stud 40 to 38. Additionally, the attempted assembly of the clamp members 76,78 about the upper stud 38 will result in an obviously loose stud 38 as a further indication of improper assembly.

In a specific illustration of an electrical device 12, the electrical device is an electronic fuse such as the Fault Filter TM Electronic Fuse that functions as an electrical fault-interrupting device; such a device being available from the assignee. For this specific electronic fuse, the electrical device 12 includes an interrupting module 100 assembled atop a control module 102; the device stud 38 of the interrupting module being connected to the connector bus 30 and the device stud 40 of the control module 102 being connected to the connector bus 34 for proper orientation; e.g. for the purpose of orienting an operation indicator. The present invention is especially desirable for a device of this type, since the interrupting module 100 is replaceable and the control module 102 is removable; this anticipated replacement and assembling requiring the use of proper modules of predetermined characteristics and the appropriate placement of the control module at the bottom of the mounting 14.

In accordance with the features of the arrangement 10 of the present invention, and assuming that the diameter D1 of the upper stud 38 corresponds to an electrical device 12 with a predetermined characteristic such as a voltage rating V1, a distinct electrical device 12 with a different characteristic such as a lower voltage rating V2 is provided with a device stud 38 of a diameter D3 which is larger than the diameters D1 and D2. Accordingly, the electrical device 12 with the lower rating cannot be assembled via the clamp 60 since the device stud 38 of the larger diameter D3 will block the bolts 68,70 from being aligned for threading into the clamp 66. It should be noted, as briefly discussed hereinbefore, that the clamp member 64 is fabricated with an inner curvature 94 to match that of the outer curvature 96 of the contact 16. Further, the inner curvature 98 of the contact 16 is fabricated to match that of the device stud 38, which is the same curvature as that of the clamp member 66. The same relationships are also provided for the clamp 62.

In the case where the control module 102 is suitable for both two devices with different characteristics, the lower device studs 40 are of equal diameter D2. In the event that different control modules are utilized for the devices, the diameter of the stud 40 of the lower rated device 12 is provided so as to prohibit assembly into the clamp 62 corresponding to the diameter D2 of the stud 40.

Considering now yet additional features of the arrangement 10 of the present invention, the specific illustrative embodiment of arrangement 10 provides a tab or leg 110 extending generally perpendicularly and inwardly from the trunnion member 46 for cooperation with a corresponding notch 112 of a blocking member 114. As seen in FIG. 1, the blocking member 114 is affixed to a hinge assembly 36 by bolts 113 so as to provide alignment of the notch 112 with the leg 110 upon insertion of the electrical device 12 with the affixed trunnion member 45,46. For a distinct electrical device 12 having a different characteristic such as a different voltage rating, the leg 110 and the notch 112 are omitted and the leg 116 shown in phantom is provided on the trunnion member 45 for alignment with a notch in the portion 118 of the blocking member 114. Accordingly, the device 12 can only be positioned in the mounting 14 via the trunnion member 46 and the leg 110 appropriate for the device 12 through the provision of the notch 112 as shown in FIG. 6; the attempted insertion of the trunnion members 45,46 of the device 12 into a hinge assembly 36 provided only with a notch 118 being blocked by the contact of the leg 110 of the trunnion member 46 with the blocking member 114. Similarly, the attampted insertion of a device 12 with the leg 116 into the hinge assembly 36 provided with the notch at 112 will also be blocked by the contact of the leg 116 with the blocking member 114 at the portion 118. Thus, the arrangement 10 of the present invention prevents the insertion and connection of a device into mountings other than those that correspond to the appropriate electrical device as to predetermined ratings or characteristics.

Turning now to other aspects of the present invention, the contacts 16 and 18 are formed from a bar of wrought copper and are provided in direct contact with the respective device studs 38,40 as discussed hereinbefore. Preferably, the contacts 16,18 are also silver-plated. This arrangement provides a direct, highly-conductive path from the device studs 38,40 to the mounting contacts 20,22 while requiring a minimum volume of material; the efficient conductive paths provided by the contacts 16,18 combining with the clamps 60,62 to provide an efficient connection to the mounting contacts 20,22 and additionally to provide the facility to prevent assembly of distinct electrical devices to the contacts other than the appropriate combinations. The conductivity of the contacts 16,18 eliminates the necessity for large castings for the contacts and the problems in obtaining highlyconductive castings; i.e. the conductivity of wrought copper is greater than can be achieved in practice with castings. In this regard, it should be realized that while the clamps 62,64,76 and 78, the trunnion members 45,46, and the assembly 42 are electrically connected to the mounting contacts 20,22, they are not required for any current carrying capabilities for the current paths 16–20 and 18–22.

In a specific embodiment, the clamp member 78 is fabricated with the trunnion member 45 as a unitary casting. Similarly, the latch member and retaining assembly 42 either includes separate members from the clamp member 64,66 or can be fabricated with the respective clamp member 64,66. Additionally, while the arrangement 10 of the present invention is described in accordance with a specific illustration including the trunnion member 45,46 and the latch assembly 42, it should be realized that the present invention in other embodiments is practiced without these specific facilities. In this regard, the specific illustration of FIGS. 1–3 also includes the provision of a carrier or holder for the electrical device 12 in the form of two insulative rods 130,132 which are provided in suitable lengths to span the appropriate spacing between the upper contact 16 and the lower contact 18. Specifically, the rods 130,132 are received at their upper ends in sleeves 134,136 of the latch member and retaining assembly 42 and at their lower ends in sleeves 138,140 in the trunnion member 45,46. The holder or carrier function provided for the electrical device 12 by the rods 130,132, the trunnion member 45,46, and the latch member and retaining assembly 42, also provide the desirable features of orientation and appropriate spacing of the contacts 16,18 for insertion into the mounting 14. Additionally, if higher voltage-rated devices 12 are of longer length from device stud 38 to device stud 40, the rods 130,132 are also of appropriate lengths. Accordingly, if it is attemtpted to assemble a high-voltage fuse into a lower-voltage mounting, the studs 38,40 will not align with the overall carrier assembly. Also, low-voltage fuses will be too short to be assembled in the longer, high-voltage carrier. However, it should be realized that the practice of the present invention does not require the rods 130,132.

Where it is desired to prevent contact of the control module 102 with the contact 18, an insulative spacer 163 is provided below the contact module 102. The insulative spacer is carried by the rods 130,132 by means of apertures 165 in the insulative spacer 163. Additionally, the trunnion member 45,46 are provided with the hooked portions 167 to retain the insulative spacer 163.

Considering now alternate arrangements of the present invention and referring now to FIGS. 8 and 9, the blocking members 150 and 160 illustrate the variety of specific patterns that may be established between the legs 110,116 of appropriate shape and the notches provided in the corresponding blocking members. For example, the blocking member 150 of FIG. 8 illustrates one manner in which a variety of mutually exclusive combinations of electrical devices and mountings may be provided. The notches 152,154 and 156 being distinguished one from the other by successive changes of both length and width. In FIG. 9, the numbered areas 1–7 of the blocking member 160 may be provided in combinations that are mutually exclusive such as 1-3-5-7, 2-4-6, 1-3-4-7, 1-2-4-5, etc. Further, it should also be realized that in other embodiments of the present invention, various other cooperating interfitting and blocking arrangements having different shapes and structure are provided in place of the legs 110,116 and nothces such as 112,118.

While there has been illustrated and described various embodiments of the present invention, it will be apparent that various changes and modifications will occur to those skilled in the art. For example, while a specific embodiment has been described wherein the diameter of the device studs is varied for preventing improper assembly and mounting, in other embodiments the various combination of size, shape, geometry, and cross section of the device connections are varied; e.g. hexagonal, square, pentagonal, etc. Accordingly, it is intended in the appended claims to cover all such changes and modifications as fall within the true spirit and scope of the present invention.

What is claimed and desired to be secured by Letters Patent of the United States is:

1. An improved connection arrangement of the type including an electrical device and a mounting, the mounting including stationary electrical connections, the electrical device including protruding electrical connection members having predetermined dimensions, distinct types of electrical devices being characterized by the electrical connection members having different predetermined dimensions, wherein the improvement comprises:

connection means including at least one conductive contact element and having predetermined structural features that cooperate with respective electrical connection members for affixing each of said contact elements to a respective electrical connection member and for preventing the assembly of each of said contact elements to electrical connection members other than those corresponding to the appropriate predetermined electrical devices, said connection means comprising means for clamping each of said contact elements to a respective electrical connection member, said clamping means comprising at least one clamp member, the electrical connection member being interposed between said at least one clamp member and said contact element, electrical connection members other than those that are appropriate for each of said contact elements interfering with clamping of said contact element with said at least one clamp member, said contact elements being dimensioned to interfit with the stationary electrical connections of the mounting; and cooperating means for preventing insertion of an electrical device into a mounting other than a predetermined, appropriate mounting for the electrical device, wherein said cooperating means comprises one or more extending members arranged in a predetermined manner with respect to said connection means, and means carried by the mounting for providing appropriate clearance to said one or more extending members and for blocking said extending members other than those corresponding to the predetermined, appropriate mounting.

2. The arrangement of claim 1 wherein each of the electrical connection members has a predetermined cross section including two opposed rounded surfaces, distinct electrcial connection members being defined by different dimensions between the opposed rounded surfaces.

3. The connection arrangement of claim 1 wherein said clearance and blocking means comprises a planar member having appropriate voids for alignment with said one or more extending members.

4. The connection arrangement of claim 1 further comprising a trunnion member carried by said connection means and a hinge member carried by the mounting, said one or more extending members being provided as one or more protuberances extending from said trunnion member.

5. The connection arrangement of claim 1 wherein said clamping means further comprises fasteners and apertures in said clamp member.

6. The arrangement of claim 5 wherein said apertures and said fasteners are arranged such that electrical connection members having cross sections larger than that corresponding to the appropriate electrical connection member cannot be clamped by said clamp member, each of said contact elements including apertures that are aligned with the apertures of said clamp member when said contact element and said clamp member are positioned about the appropriate interposed electrical connection member, said fasteners being assembled through said apertures of said contact element and into said apertures of said clamp member, electrical connection members of larger cross section interferring with the alignment of said fasteners through said apertures.

7. The arrangement of claim 1 wherein each of said contact elements is fabricated from a bar of wrought copper and includes a portion having a surface characteristic that conforms to a portion of the corresponding electrical connection member.

8. The arrangement of claim 1 wherein each of the electrical connection members has a cross section that is generally circular, an electrical device having first predetermined characteristics including an electrical connection member of diameter D1, an electrical device having second predetermined characteristics including an electrical connection member of diameter D3, where D3 is different than D1.

9. The arrangement of claim 8 wherein each electrical device includes two electrical connection members, the diameter of a second electrical connection member of each of the electrical devices having the first or second predetermined characteristics being D2.

10. The arrangement of claim 9 wherein the diameter D2 is greater than D1 and less than D3.

11. The arrangement of claim 9 wherein the electrical device includes two assembled modules, a first module including the first electrical connection member, the second module being the same for each of the electrical devices having either the first or second predetermined characteristics.

12. A connection arrangement comprising:

an electrical device including at least two conductive device studs;

a mounting including at least two stationary contacts;

a conductive contact element for each of said device studs;

at least one clamp member for each of said device studs;

means for fastening said at least one clamp member to said contact element, each of said device studs being interposed between said conductive contact element and said at least one clamp member, said contact element and said at least one clamp member being configured and cooperating with said fastening means such that said device studs that are larger than a first predetermined dimension interfere with and prevent said fastening means from fastening said at least one clamp member to said contact element about said device studs of dimensions larger than said first predetermined dimension, each of said contact elements interfitting with a respective one of said stationary contacts of said mounting; and an extending member carried with one of said contact elements and a cooperating planar member carried by said mounting, said planar member providing clearance to said extending member.

13. A connection kit having component parts capable of being assembled with an electrical device for connecting the electrical device to a mounting, the electrical device having at least two conductive device studs of predetermined dimensions, the mounting including at least two stationary contacts, the kit comprising the combination of:

a conductive contact element for each device stud;

at least one clamp member for each device stud;

means for fastening said at least one clamp member to said contact element, each of the device studs being interposed between said conductive contact element and said at least one clamp member, said contact element and said at least one clamp member being adapted to cooperate with said fastening means such that device studs that are larger than a first predetermined dimension interfere with and prevent said fastening means from fastening said at least one clamp member to said contact element about the device studs of dimensions larger than the first predetermined dimension, each of said contact elements interfitting with a respective one of the stationary contacts of the mounting; and an extending member carried with one of said contact elements and a cooperating planar member carried by said mounting, said planar member providing clearance to said extending member.

* * * * *